US010773401B2

(12) United States Patent
Walker, Jr. et al.

(10) Patent No.: US 10,773,401 B2
(45) **Date of Patent: *Sep. 15, 2020**

(54) SHAVING RAZOR CARTRIDGE AND METHOD OF ASSEMBLING

(71) Applicant: The Gillette Company LLC, Boston, MA (US)

(72) Inventors: Vincent Paul Walker, Jr., Bridgewater, MA (US); Nicholas Robert Harrington, Natick, MA (US); Alejandro Carlos Lee, Cambridge, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/697,591

(22) Filed: Sep. 7, 2017

(65) Prior Publication Data

US 2018/0071929 A1 Mar. 15, 2018

(30) Foreign Application Priority Data

Sep. 9, 2016 (EP) ..... 16188222

(51) Int. Cl.
*B26B 21/22* (2006.01)
*B26B 21/40* (2006.01)
*B26B 21/44* (2006.01)

(52) U.S. Cl.
CPC ..... *B26B 21/222* (2013.01); *B26B 21/227* (2013.01); *B26B 21/4006* (2013.01);
(Continued)

(58) Field of Classification Search
CPC . B26B 21/222; B26B 21/227; B26B 21/4006; B26B 21/4018; B26B 21/4025;
(Continued)

(56) References Cited

U.S. PATENT DOCUMENTS 4,492,025 A 1/1985 Jacobson
4,831,731 A * 5/1989 Elits ..... B26B 21/22 30/41.6

(Continued)

OTHER PUBLICATIONS

EPO Search Report with Written Opinion in corresponding EPO application 16188222.0 dated Mar. 1, 2017.

*Primary Examiner* — Stephen Choi
(74) *Attorney, Agent, or Firm* — John M. Lipchitz

(57) ABSTRACT

In one aspect, the invention features, in general, a shaving razor cartridge with a housing having a primary guard at a front of the housing, a secondary cap at a rear of the housing and at least one spring member positioned between the primary guard and the secondary cap. A bridge member is positioned between the primary guard and the secondary cap. The bridge member has a primary cap surface and a secondary guard surface. A first blade having a cutting edge is mounted to at least one of the spring members between the primary guard and the primary cap surface. A second blade having a cutting edge is mounted to at least one of the spring members between the secondary guard surface and the secondary cap. The bridge member is mounted on a plurality of the spring members.

4 Claims, 7 Drawing Sheets

(52) U.S. Cl.
CPC ..... *B26B 21/4018* (2013.01); *B26B 21/4025* (2013.01); *B26B 21/4031* (2013.01); *B26B 21/4075* (2013.01); *B26B 21/443* (2013.01)

(58) Field of Classification Search
CPC ..... B26B 21/4031; B26B 21/4075; B26B 21/443
See application file for complete search history.

(56) References Cited

U.S. PATENT DOCUMENTS

| | | | | |
|---|---|---|---|---|
| 5,369,885 | A | 12/1994 | Ferraro | |
| 5,802,721 | A | 9/1998 | Wain et al. | |
| 2005/0115073 | A1* | 6/2005 | Brown | B26B 21/00 30/50 |
| 2011/0146079 | A1 | 6/2011 | Clarke et al. | |
| 2012/0317818 | A1 | 12/2012 | Oglesby et al. | |

* cited by examiner

SHAVING RAZOR CARTRIDGE AND METHOD OF ASSEMBLING

FIELD OF THE INVENTION

The present invention relates to shaving razors and more particularly to shaving cartridges having two guards, two caps, and a plurality of blades.

BACKGROUND OF THE INVENTION

In general, shaving razors of the wet shave type include a cartridge or blade unit with at least one blade with a cutting edge, which is moved across the surface of the skin being shaved by means of a handle to which the cartridge is attached. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled (i.e., disposable razor). The connection of the cartridge to the handle provides a pivotal mounting of the cartridge with respect to the handle so that the cartridge angle adjusts to follow the contours of the surface being shaved. In such systems, the cartridge can be biased toward a rest position by the action of a spring-biased plunger (a cam follower) carried on the handle against a cam surface on the cartridge housing.

Razor cartridges usually include a guard which contacts the skin in front of the blade(s) and a cap for contacting the skin behind the blade(s) during shaving. The cap and the guard aid in establishing the so-called "shaving geometry", i.e., the parameters which determine the blade orientation and position relative to the skin during shaving, which in turn have a strong influence on the shaving performance and efficacy of the razor. The cap and the guard may aid in establishing the exposure of the blades. The blade exposure is defined to be the perpendicular distance or height of the blade edge measured with respect to a plane tangential to the skin contacting surfaces of the blade unit elements next in front of and next behind the edge. Therefore, for a three-bladed blade unit, the exposure of the first or primary blade is measured with reference to a plane tangential to the guard and the edge of the second blade, and the exposure of the third or tertiary blade is measured with reference to a plane tangential to the edge of the second blade and the cap.

The minimum acceptable exposure may be influenced by other blade unit dimensions, such as the distance from the skin engaging surface of the guard to the edge, i.e. "the span" of the primary blade. As referred to herein, "the span" means the distance from the blade edge to the skin contacting element immediately in front of that edge as measured along a tangent line extending between the said element and the blade edge. The guard may include a generally rigid guard bar that may be formed integrally with the housing or platform structure, which provides a support for the blades. Guards may also include skin stretching elements made from various types of elastomeric materials that are intended to stretch the skin and/or align hair in front of the blade.

Safety razors having cartridges with several blades have in recent years been sold in very large numbers and are generally acknowledged to give a better quality of shave, especially in terms of closeness, than single bladed razors. A blade unit having many blades can produce a closer shave than a similar blade unit with only one or two blades. However, closeness of shave obtained is only one parameter by which razor users judge the performance of a razor.

Comfort is another important characteristic to consider. For example, many consumers describe themselves as having sensitive skin, which is prone to nicks, cuts and irritation. Discomfort during a shave, often described by shavers as a "pull & tug" sensation is caused by the nerves around the follicle being stimulated. This nerve stimulation can happen by moving the hairs, pulling and/or cutting the hairs and by dragging the razor cartridge over the surface of the skin.

Additionally, many consumers suffer from acne and/or pseudofolliculitis barbae (PFB) that make shaving uncomfortable. PFB or shaving bumps is a foreign body inflammatory reaction involving papules and pustules. It is a common dermatologic condition principally affecting adult men who have naturally coarse or tightly curling hair, particularly those who shave closely on a regular basis. The leading edge of closely cropped facial hair re-entering the epidermis of the skin or transecting the wall of the hair follicle results in localized inflammatory reactions over the affected site. The process can lead to secondary skin infections and, in severe cases, permanent scarring. Accordingly, what is needed is a shaving razor cartridge that provides a more comfortable shave and/or decrease skin issues caused by shaving the face and body (e.g., PFB, irritation, redness, razor bumps, ingrown hairs, acne etc.).

SUMMARY OF THE INVENTION

In one aspect, the invention features, in general, a shaving razor cartridge with a housing having a primary guard at a front of the housing, a secondary cap at a rear of the housing and at least one spring member positioned between the primary guard and the secondary cap. A bridge member is positioned between the primary guard and the secondary cap. The bridge member has a primary cap surface and a secondary guard surface. A first blade having a cutting edge is mounted to at least one of the spring members between the primary guard and the primary cap surface. A second blade having a cutting edge is mounted to at least one of the spring members between the secondary guard surface and the secondary cap. The bridge member has a pair of spaced apart legs that are mounted on at least one of the spring members.

In another aspect, the invention features, in general, a method of assembling a shaving razor cartridge by providing a housing having a primary guard and a secondary cap. A first blade having a cutting edge is mounted to the housing. A second blade having a cutting edge is mounted to the housing. A bridge member having a pair of spaced apart legs is mounted to the housing immediately between the first blade and the second blade. The first blade, the second blade and the bridge member are secured to the housing with at least one clip.

In yet another aspect, the invention features, in general, a bridge member for a shaving razor cartridge with a pair of generally parallel spaced apart legs configured for mounting within a pair of respective blade slots of a cartridge housing. An upper surface extends across the legs. The upper surface has a width of 1.5 mm to 4 mm.

The details of one or more embodiments of the invention are set forth in the accompanying drawings and the description below. Other features and advantages of the invention will be apparent from the description and drawings, and from the claims.

DETAILED DESCRIPTION OF THE INVENTION

Figure 1:
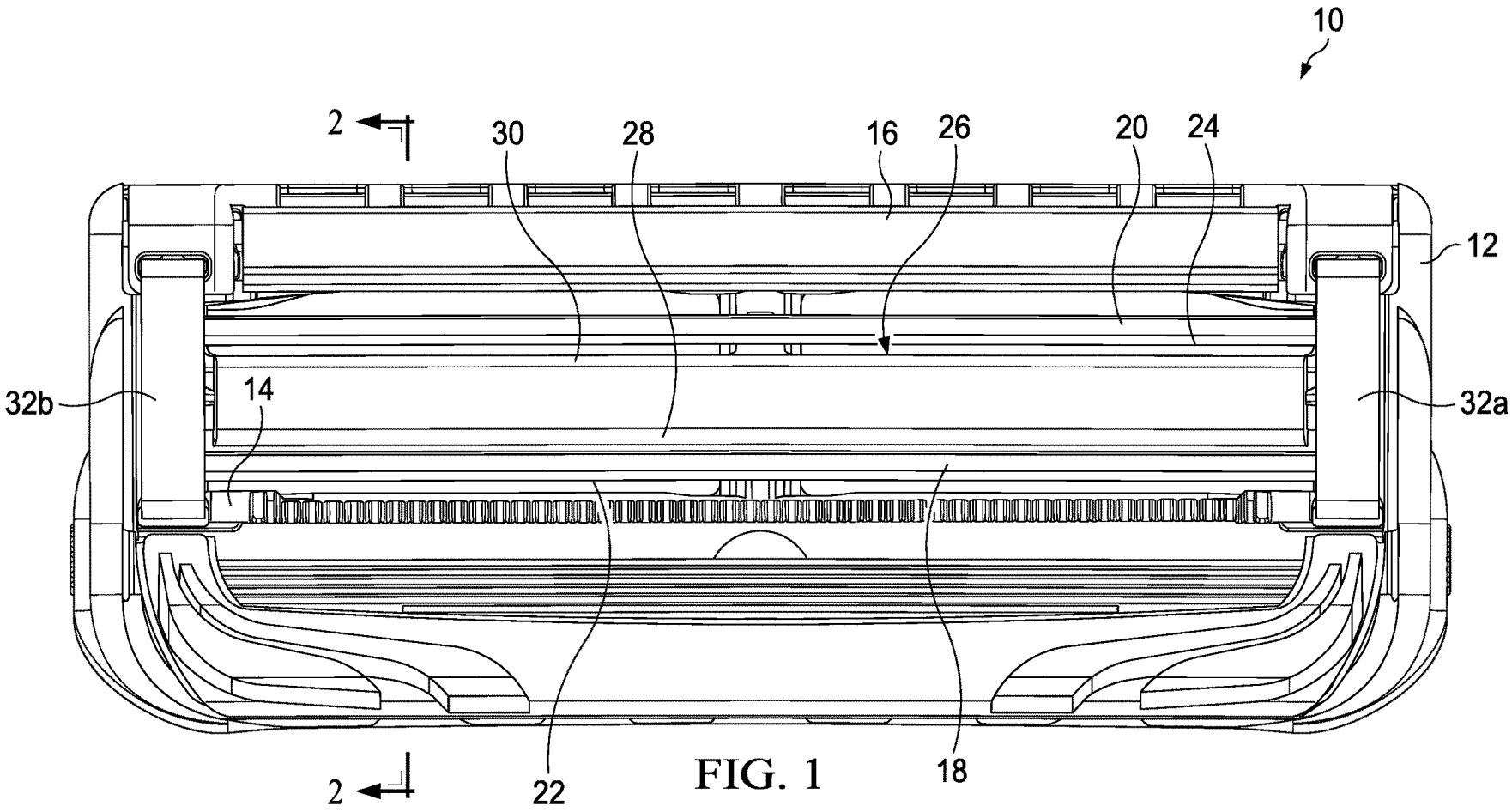
FIG. 1 is a top view of a shaving razor cartridge.

Referring to FIG. 1, a top view is shown of a shaving razor cartridge 10. The shaving razor cartridge 10 may include a housing 12 having a primary guard 14 toward a front of the housing 12 and a secondary cap 16 toward a rear of the housing 12. In certain embodiments, there may be a first blade 18 and a second blade 20 mounted to the housing 12 between the primary guard 14 and the secondary cap 16. Each of the blades 18 and 20 may have a respective cutting edge 22 and 24 facing in the same direction (e.g., toward the primary guard 14). The blades 18 and 20 may be rigidly fixed to the housing 12 such that the blades 18 and 20 do not move relative to the housing 12 during a shaving stroke or the blades 18 and 20 may be spring mounted.

A bridge member 26 may be positioned between the first blade 18 and the second blade 20. The bridge member 26 may have a primary cap surface 28 and a secondary guard surface 30. Accordingly, the primary guard 14 and the primary cap surface 28 may establish a shaving plane for the first cutting edge 22. Similarly, the secondary guard surface 30 and the secondary cap 16 may establish the shaving plane for the second blade edge 24. In certain embodiments, the secondary guard surface 30 and the primary cap surface 28 may be a unitary member. The bridge member 26 may be a separate component that is mounted to the housing 12. The bridge member 26 may comprise a metal, such as aluminum, copper or stainless steel.

The blades 18 and 20 and the bridge member 26 may be secured to the housing 12 with at least one clip 32*a* and 32*b* that is bent around a portion of the housing 12. Although the clips 32*a* and 32*b* are shown as two separate components securing the blades 18 and 20 and the bridge member 26 to the housing 12, the clips 32*a* and 32*b* may also be a single piece design. In addition, the clips 32*a* and 32*b* may not necessarily be bent or formed around a portion of the housing 12 to secure the blades 18 and 20 and the bridge member 26 relative to the housing 12. For example, the clips 32*a* and 32*b* may be snapped fit, press fit, glued, or ultrasonically welded to the housing 12. The clips 32*a* and 32*b* may comprise a metal (e.g., aluminum or stainless steel) or a polymeric material (e.g., Noryl™ (a blend of polyphenylene oxide (PPO) and polystyrene developed by General Electric Plastics, now SABIC Innovative Plastics), acrylonitrile butadiene styrene (ABS), acetal, polypropylene, high impact polystyrene, or any combinations thereof. The clips 32*a* and 32*b* may contact the cutting edges 22 and 24 of the respective blades 18 and 20 to establish a shaving plane.

In certain embodiments, the clips 32*a* and 32*b* may not contact the primary cap surface 28 and/or the secondary guard surface 30 to facilitate proper positioning of the primary cap surface 28 and the secondary guard surface 30 relative to the cutting edges 22 and 24. For example, if the clips 32*a* and 32*b* extended over or around the bridge member 26, the clips 32*a* and 32*b* may prevent proper skin and hair contact with the cutting edges 22 and 24 because the clips 32*a* and 32*b* are positioned above the primary cap surface 28 and the secondary guard surface 30. Furthermore, the position of the bridge member 26 would be limited by the thickness of the clips 32*a* and 32*b*.

It is believed, without being held to theory, that it is possible to minimize skin irritation and PFB by cutting hair close to skin level, but not below the skin's surface. Multi-blade shaving razor cartridges take advantage of what is known as the hysteresis effect. Hysteresis is the meta-stable extension of hair that occurs after a hair is cut during shaving. In present day razors, sharp cutting edges of the cartridge engage with individual hairs during a shaving stroke, exerting a force on the hairs and causing them to be lifted out of the follicle as the razor is moved across the surface of the skin. Once the hair has been cut and the force is removed, the hair retracts back into the skin. However, in multi-bladed systems, a trailing blade (i.e., second blade) engages the hair and cuts it before the hair is able to retract back into the skin. This concept of consecutive blades cutting hairs before they have fully retracted into the skin is known as "hysteresis cutting". If the second and consecutive blades also engage and pull hairs while cutting, it becomes possible to get a significantly closer cut than when using a single blade razor.

In razor cartridges with multiple, closely spaced, blades it is possible that a single hair may be subjected to engagement with more than one blade during a single cutting episode, multiplying the stimulation of the nerve and the sensation of discomfort. Less closely spaced blades are less likely to engage the same hair in a single cutting episode and therefore less likely to exaggerate nerve stimulation, and discomfort. It is believed, without being held to theory, that uncomfortable nerve stimulation may be reduced by decreasing the likelihood of single hairs engaging with multiple blades during a cutting episode. Furthermore, decreasing the likelihood of single hairs engaging with multiple blades during a cutting episode may help prevent the hair from being cut too close or below the skin's surface, which may limit growing hair from re-entering the epidermis of the skin.

Figure 2:
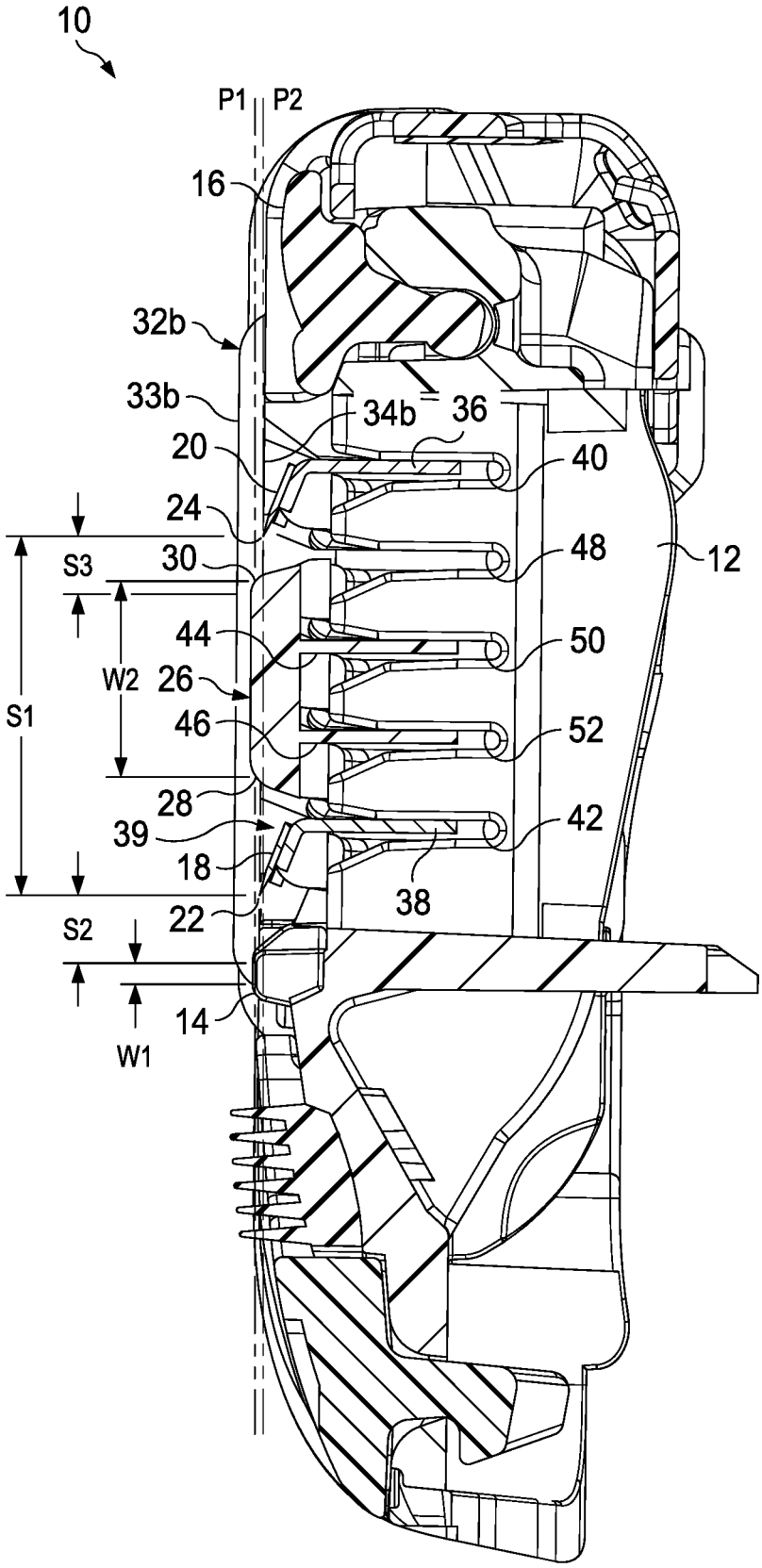
FIG. 2 is a section view of the shaving razor cartridge, taken generally along the line 2-2 of FIG. 1.

Referring to FIG. 2, a cross section view of the shaving razor cartridge 10 is shown, taken generally along the line 2-2 of FIG. 1. The primary guard 14 may have a width "W1" of about 0.35 mm to about 0.85 mm. The bridge member 26 may provide sufficient spacing between the two cutting edges 22 and 24 to allow the hair to retract further into the hair follicle compared to typical shaving systems. The further the cutting edges 22 and 24 are spaced apart, the longer the time the hair has to retract. The second cutting edge 24 may not cut the same hair as the first cutting edge 22, but may just cut any hairs missed by the first cutting edge 22. In certain embodiments, an interblade span "S1" between the cutting edge 22 of the first blade 18 and the cutting edge 24 of the second blade 20 may be about 3 mm to about 6 mm. For example, the interblade span "S1" between the cutting edge 22 of the first blade 18 and the cutting edge 24 of the second blade 20 may be greater than 4.2 mm to provide sufficient spacing to provide a more comfortable shave. The interblade span "S1" between the cutting edge 22 of the first blade 18 and the cutting edge 24 of the second blade 20 may be greater than a span "S2" between the primary guard 14 and the cutting edge 20 of the first blade 18. The interblade span "S1" between the cutting edge 22 of the first blade 18 and the cutting edge 24 of the second blade 20 may also be greater than a span "S3" between the secondary guard surface 28 and the cutting edge 24 of the second blade 20. In certain embodiments, the interblade span "S1" may be about 6 to about 12 times greater than the spans S2 and/or S3. The interblade span S1 may help minimize double engagement of hair, which may result in discomfort and hairs being cut below the skin surface.

The blades 18 and 20 may have a respective blade support member 38 and 36. The support members may be a unitary part of the blades 18 and 20 or alternatively, the blades 18 and 20 may be mounted and secured (e.g., welded) to the respective blade support members 36 and 38. The blade support members 36 and 38 may be positioned within respective blade slots 40 and 42 of the housing 12. The bridge member 26 may include a pair of spaced apart legs 44 and 46 extending in a transverse direction to the bridge member 26. The housing 12 may have a plurality of blade slots 48, 50 and 52 between the blades 18 and 20. The spaced apart legs 44 and 46 may be positioned within the blade slots 50 and 52, respectively. The spaced apart legs 44 and 46 may provide for improved stability of the bridge member 26 during a shaving stroke, especially as the size of the bridge member 26 increases (e.g., width in a front to rear direction). A single legged bridge member may be more likely to tip or rock within the housing 12 during a shaving stroke because the forces are not as well balanced as the bridge member 26 having two spaced apart legs 44 and 46. In addition, the two legs 44 and 46 may better distribute the shaving forces to the housing 12 compared to a single leg. The bridge member 26 may be spaced apart from the first blade 18 (and the blade support member 38) to define a rinse gap 39 there between. The rinse gap 39 may facilitate the removal of shaving debris (e.g., cut hairs and/or shave prep). Accordingly, less shaving debris may be present when the second blade 20 engages and cuts hair, thus resulting in a more efficient and comfortable shave. The spaced apart legs 44 and 46 may allow for improved spacing of the bridge member 26. In certain embodiments, the spacing of the legs may be less than the overall width of the bridge member 26, which may allow for improved rinsing. For example, if the legs 44 and 46 were spaced apart by the same distance as the width of the bridge member 26, shaving debris may more likely be trapped between leg 46 and blade support member 38. The legs 44 and 46 may be spaced apart by about 1 mm, for example, 0.5 mm to 1.5 mm.

The blade slot 48 between the second blade 20 (or blade support 36) and the bridge member 26 may be open (i.e., no component may be located within the blade slot 48). In certain embodiments, the bridge member 26 may overlap the open blade slot 48. Typical multi-blade cartridge housings utilize blade slots that receive a blade and/or blade support member. The bridge member 26 may allow for a more comfortable shave without the need to design or manufacture a new housing by utilizing the same housing and providing a larger skin support area between the blade 18 closest to the primary guard 14 and the blade 20 that is closest to the secondary cap 16. For example, the housing 12 may be the same housing that is used for a five-bladed shaving cartridge, but only requires the bridge member 26 and two blades 18 and 20.

Figure 4:
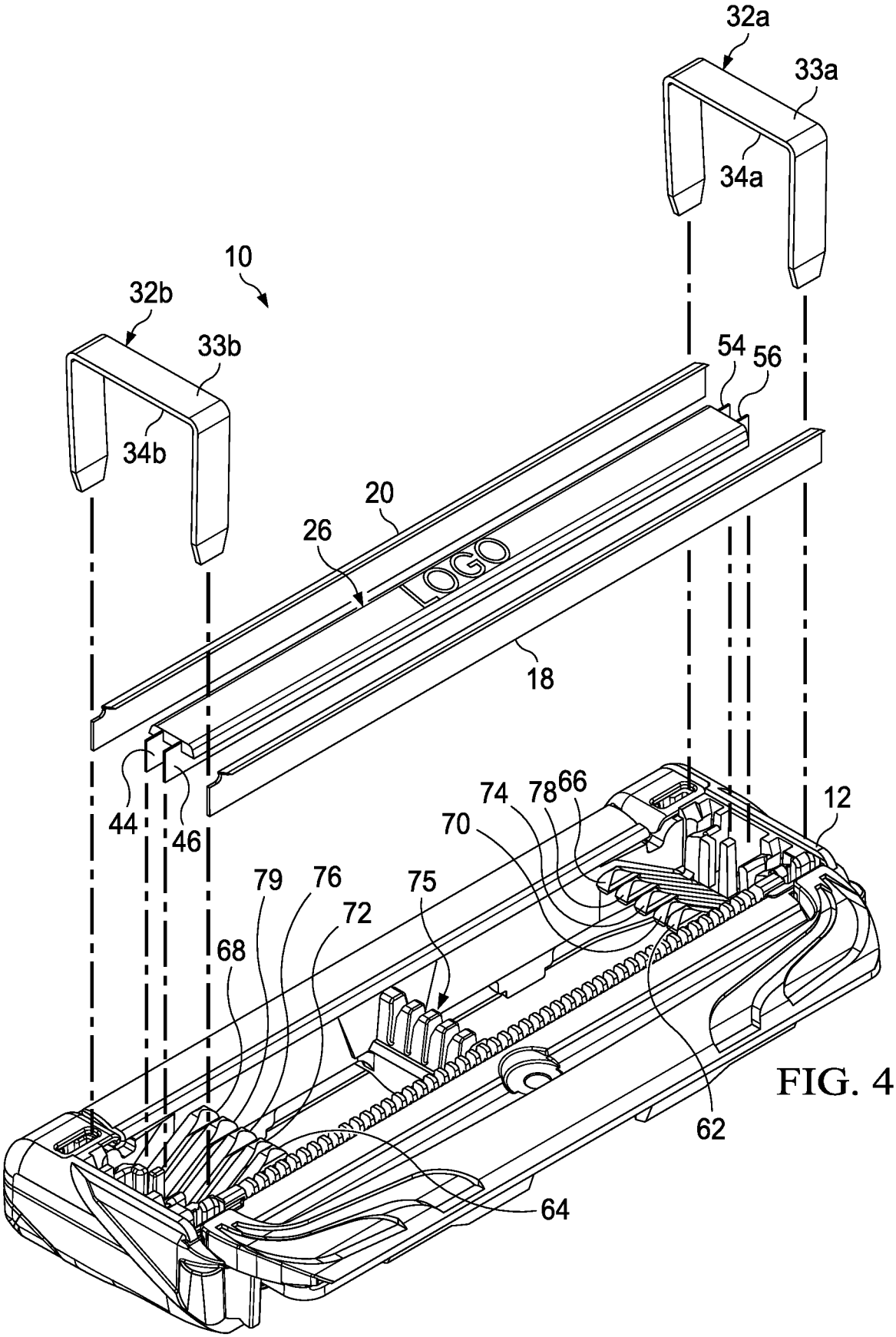
FIG. 4 is an assembly view of the shaving razor cartridge of FIG. 1.

In certain embodiments, it may be advantageous for primary cap surface 28 and the secondary guard surface 30 of the bridge member 26 to be positioned above the cutting edges 22 and 24, which may be preloaded against the bottom surface 34*b* of the respective clips 32*b*. The primary cap surface 28 and the secondary guard surface 30 of the bridge member 26 may be positioned on a plane P1 between a top surface 33*b* and the bottom surface 34*b* of the respective clip 32*b*. Although only one clip 32*b* is shown in FIG. 2, it is understood clip 32*a* may also have a corresponding top surface 33*a* and bottom surface 34*a* (as shown in FIG. 4) and the bridge member 26 may be mounted in a similar fashion in respect to clip 32*b*.

The bridge member 26 may have a width "W2" to facilitate proper shaving geometry for minimizing double engagement of hairs and preventing hair from being cut below the skin surface. The width "W2" may be measured as an overall width of the bridge member 26 (in a front to rear direction) measured at a plane P2 tangent to the cuttings edges 22 and 24 (e.g., at bottom surface 34*b* of the clip 32*b*). In certain embodiments, W2 may be about 1.75 mm to about 4 mm, preferably about 2 mm to about 3 mm. The width of the bridge member 26 may facilitate establishing proper shaving geometry and prevent hair from being cut below the skin surface. For example, the width W2 of the bridge member 26 may facilitate sufficient spacing between the cutting edges 22 and 24 to allow the hairs to retract back into the hair follicle after being cut by the cutting edge 22 of the first blade 18 prior to being engaged by the cutting edge 24 of the second blade 20. Furthermore, the width and spacing of the bridge member 26 may reduce double engagement of hair (e.g., when both cutting edges 22 and 24 engage the same hair at the same time). As the interblade span S1 increases, skin bulge between the cuttings edges 22 and 24 may also increase, which may result in increased nicks and cuts. The width of the bridge member 26 may provide improved skin support to minimize skin bulge, which can result in nicks, cuts and discomfort, especially as the interblade span S1 increases.

In certain embodiments, the width of the bridge member W2 may be greater than 45% of the interblade blade span S1. For example, the width of the bridge member W2 may be about 50% to about 75% of the interblade blade span S1. Accordingly, if the interblade span S1 was 4.0 mm, then the width W2 of the bridge member 26 may be greater than 2.0 mm. In certain embodiments, the width of the bridge member W2 may be about 60% to about 70% of the interblade blade span S1. The wider bridge member 26 may provide increased skin support that results in a more comfortable shave by reducing skin bulge while also minimizing double engagement of hairs and hysteresis.

Figure 3A:
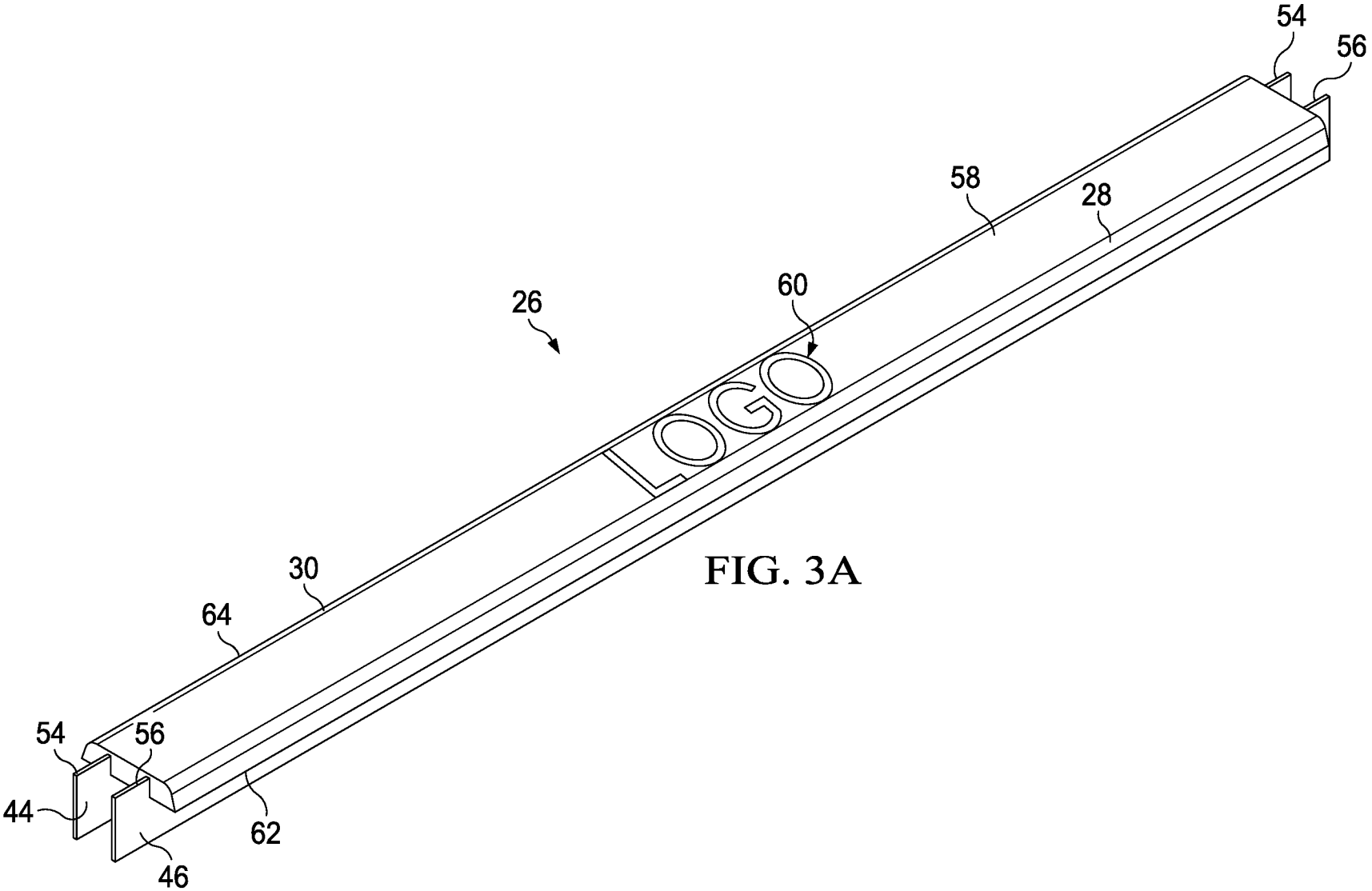
FIG. 3A is a perspective view of one possible embodiment of a bridge member that may be incorporated into the shaving razor cartridge of FIG. 1.

Referring to FIG. 3A, a perspective view of the bridge member 26 is shown. The bridge member 26 may have a forward edge 62 and a rear edge 64. In certain embodiments, the forward edge 62 and/or the rear edge 64 may overlap the respective legs 44 and 46 to provide sufficient spacing between the blades 18 and 20 while also allowing the bridge member 26 to fit within the housing 12 (as shown in FIG. 2). Each of the legs 44 and 46 may have a respective top surface 54 and 56. The top surfaces 54 and 56 may be recessed lower than the upper surface 58 to provide an area to mount the clips 32*a* and 32*b* of FIG. 1. Accordingly, when the clips 32*a* and 32*b* are secured to the housing 12, the clips 32*a* and 32*b* may be approximately the same height as the upper surface 58 of the bridge member 26, thus providing a more uniform surface of the shaving razor cartridge 10, as shown in FIG. 2. The legs 44 and 46 may be separate components that are mounted to the bridge member 26 or they may be manufactured as a unitary component with the bridge member 26. The primary cap surface 28 and the secondary guard surface 30 may be arcuate to provide a comfortable skin support surface. The bridge member 26 may have an upper surface 58 extending across the legs 44 and 46. The upper surface 58 between the primary cap surface 28 and the secondary guard surface 30 may be generally flat. The flat upper surface 58 may allow for branding on the bridge member 26. For example, an insignia 60 may be positioned on the upper surface 58 by machining, etching, molding, painting, etc. It is understood that although the bridge member 26 is shown as a flat rectangular shape, numerous other shapes are also possible, such as rounded surfaces.

In certain embodiments, the primary cap surface 28, the secondary guard surface 30 and/or the upper surface 58 may have a coefficient of friction that is less than a coefficient of friction of the primary guard 14. For example, the primary cap surface 28, the secondary guard surface 30 and/or the upper surface 58 may have a glossy surface (e.g., 6000 Grit Diamond Buff to 1200 Grit Diamond Buff) to improve glide during a shaving stroke. The bridge member 26 (i.e., the secondary guard surface 30 and/or the upper surface 58) may be coated (poly-para-Xylylene or PTFE) or plated (e.g., chrome plating) to improve lubricity. Alternatively, the primary cap surface 28, the secondary guard surface 30 and/or the upper surface 58 may have a very rough surface to provide for exfoliation of the skin during a shaving stroke (e.g., 600 grit stone or less). The primary cap surface 28, the secondary guard surface 30 and the upper surface 58 may be manufactured from anodized aluminum to improve lubricity and provide color options for the bridge member 26. The bridge member 26 may be manufactured by wire EDM, machining or stamping various metals (e.g., stainless steel, copper or aluminum).

Figure 3B:
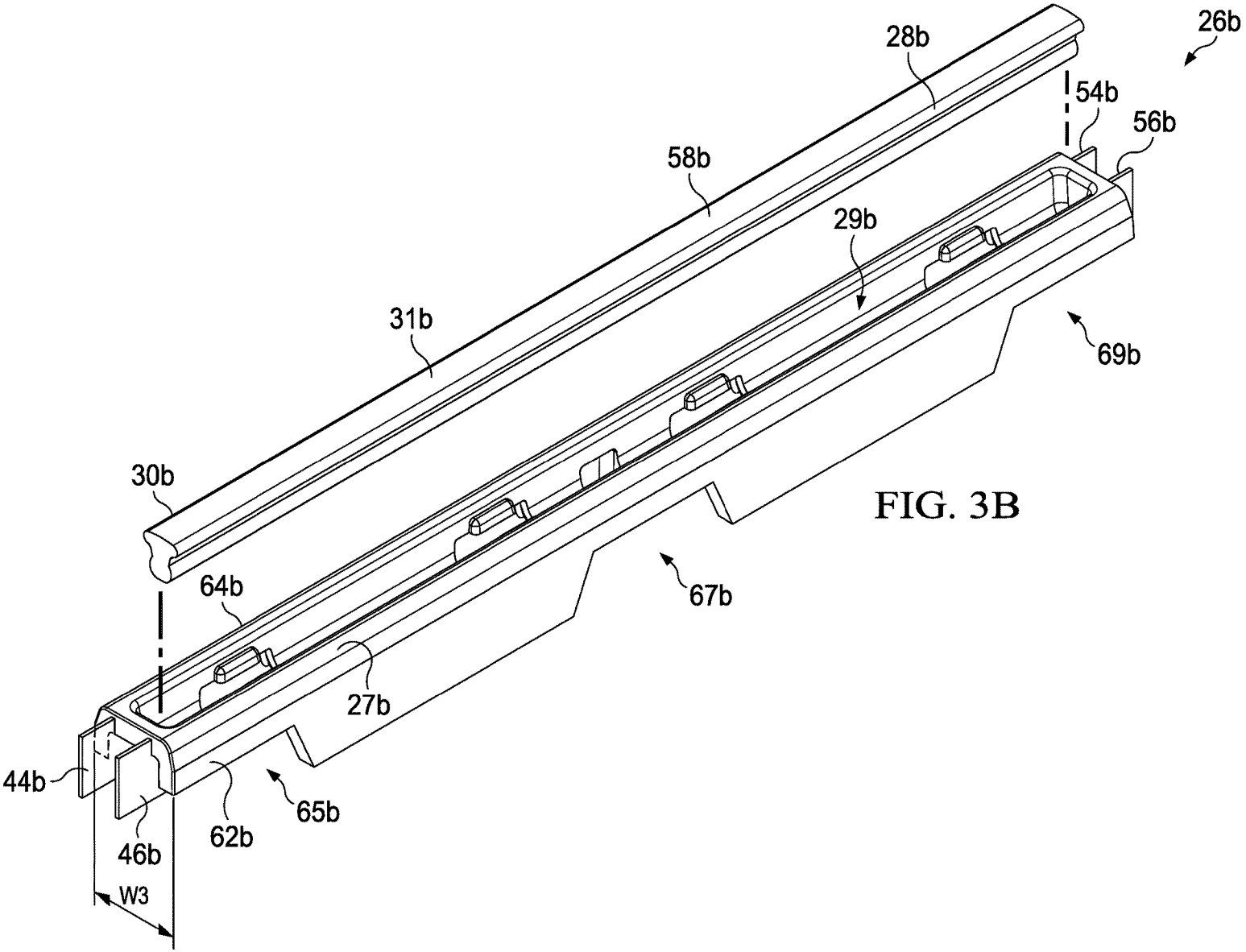
FIG. 3B is a perspective view of another possible embodiment of a bridge member that may be incorporated into the shaving razor cartridge of FIG. 1.

Referring to FIG. 3B, a perspective view of a second possible embodiment of a bridge member 26*b* is shown. The bridge member 26*b* may be substituted for the bridge member 26 in the shaving cartridge 10 of FIGS. 1 and 2. For example, the bridge member 26*b* may be inserted into the housing 12, as described for bridge member 26 in FIG. 2. The bridge member 26*b* may include a pair of legs 44*b* and 46*b* that have a respective top surface 54*b* and 56*b*. The legs 44*b* and 46*b* may be interconnected by a top surface 27*b*. The legs 44*b* and 46*b* may be separate components or they may be manufactured as a unitary component with the top surface 27*b*. The top surface 27*b* may define an opening 29*b* configured to receive a lubrication member 31*b*. The opening 29*b* may be a recess or extend completely through the top surface 27*b*. The lubrication member 29*b* may comprise a water leachable shaving aid that is injection molded, extruded, or thermal/ultrasonic compression. The lubrication member 29*b* may provide a primary cap surface 28*b* and a secondary guard surface 30*b*. Accordingly, the lubrication member 29*b* may provide for lubrication in front of (e.g., blade 20 of FIG. 2) and behind (e.g., blade 18 of FIG. 2) one or more blades, which may reduce irritation or eliminate the need for shave prep. The primary cap surface 28*b* and/or the secondary guard surface 30*b* may be arcuate to provide a comfortable skin support surface. The bridge member 26*b* may have an upper surface 58*b* between the primary cap surface 28*b* and the secondary guard surface 30*b*. The upper surface 58*b* may allow for branding on the bridge member 26*b*, as previously described above.

The legs 44*b* and 46*b* may have respective top surfaces 54*b* and 56*b* that are recessed lower than the upper surface 58*b* to provide an area to mount the clips 32*a* and 32*b*, as shown in FIG. 1. Accordingly, when the clips 32*a* and 32*b* are secured to the housing 12, the clips 32*a* and 32*b* may be approximately the same height as the upper surface 58*b* of the bridge member 26*b*, thus providing a more uniform surface of the shaving razor cartridge 10. The bridge member 26*b* may have a width "W3" from a forward edge 62*b* to a rear edge 64*b* of about 1.5 mm to about 4 mm. The width W3 of the bridge member 26*b* may allow for proper shaving geometry to minimize double engagement of hairs and prevent hair from being cut below the skin surface. In certain embodiments, the bridge member 26*b* may be 3 to 5 times wider than the width of the primary guard 14. In certain embodiments, the bridge member 26 may have one or more notches 65*b*, 67*b* and 69*b* to provide clearance for various housing structures. For example, notches 65*b* and 69*b* may allow for clearance of the spring members 62, 64, 66, 68, 70, 72, 74, 76 and 78 (shown in FIG. 4) and notch 67*b* may provide for clearance of a central blade support 75 in the housing 12 (shown in FIG. 4). Although in the view shown, only the notches 65*b*, 67*b* and 69*b* are illustrated, it is understood the other side of the bridge member 26*b* may have similar notches.

Figure 3C:
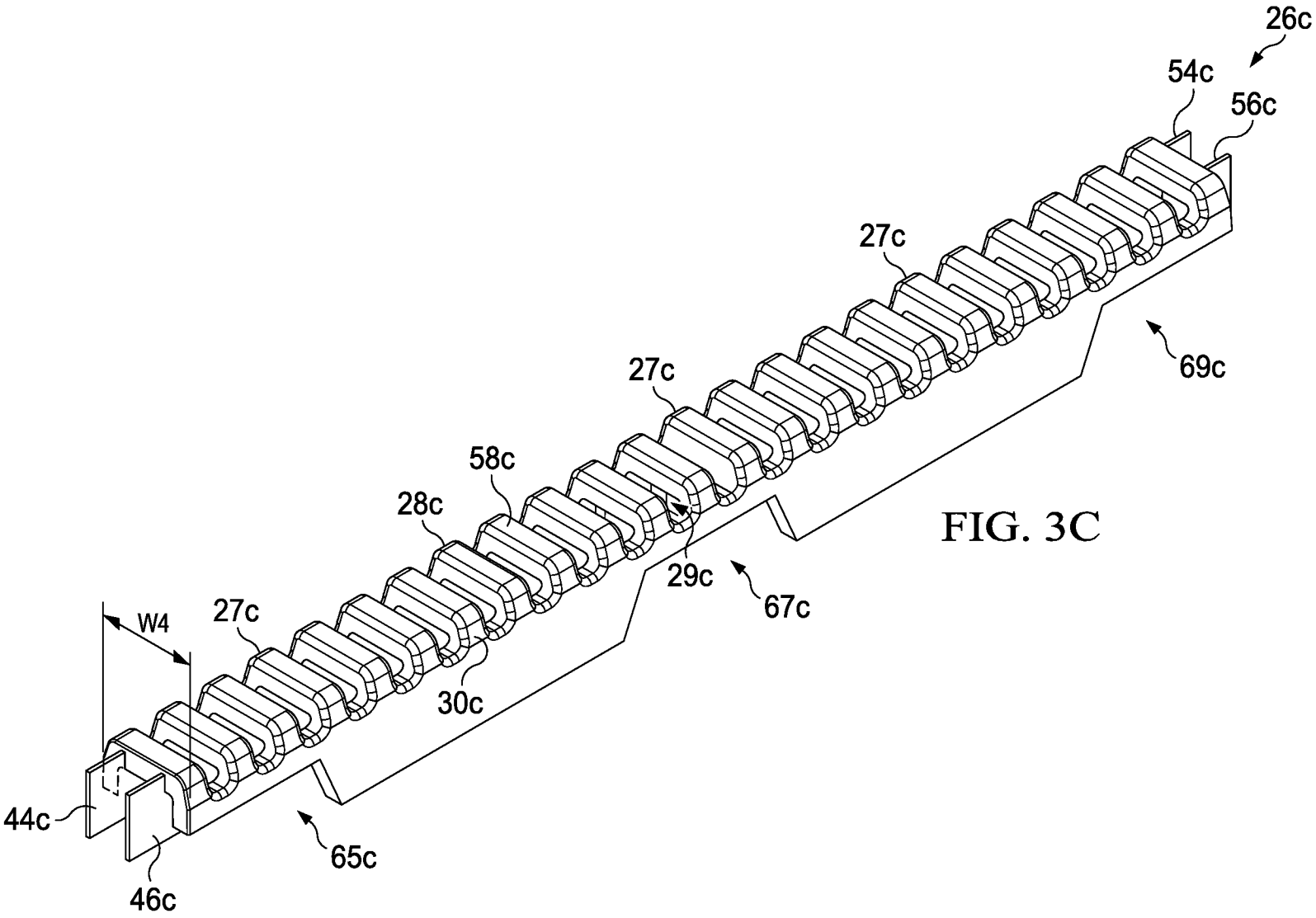
FIG. 3C is a perspective view of another possible embodiment of a bridge member that may be incorporated into the shaving razor cartridge of FIG. 1.

Referring to FIG. 3C, a perspective view of another possible embodiment of a bridge member 26*c* is shown. The bridge member 26*c* may be substituted for the bridge member 26 in the shaving cartridge 10 of FIGS. 1 and 2. For example, the bridge member 26*c* may be inserted into the housing 12, as described for bridge member 26 in FIG. 2. The bridge member 26*c* may include a pair of legs 44*c* and 46*c* that have a respective top surface 54*c* and 56*c*. The legs 44*c* and 46*c* may be interconnected by a plurality of spaced apart parallel ribs 27*c*. The legs 44*c* and 46*c* may be separate components or they may be manufactured as a unitary component with the plurality of spaced apart parallel ribs 27*c*. The plurality of spaced apart parallel ribs 27*c* may provide a primary cap surface 28*c* and a secondary guard surface 30*c*. The ribs 27*c* may have an upper surface 58*c* between the primary cap surface 28*c* and a secondary guard surface 30*c*.

The top surfaces 54*c* and 56*c* of the legs 44*c* and 46*c* may be recessed lower than the upper surface 58*c* to provide an area to mount the clips 32*a* and 32*b* of FIG. 1. Accordingly, when the clips 32*a* and 32*b* are secured to the housing 12, the clips 32*a* and 32*b* may be approximately the same height as the upper surface 58*c* of the bridge member 26*c*, thus providing a more uniform surface of the shaving razor cartridge 10. The bridge member 26*c* may have a width "W4". The width "W4" may be measured the same way as the width "W2" shown in FIGS. 2 and 3A. The width "W4" may be measured as an overall width of the bridge member 26 (in a front to rear direction) measured at the plane P2 tangent to the cuttings edges 22 and 24 (e.g., at bottom surface 34*a* and 34*b* of the clips 32*a* and 32*b*. The width of the bridge member 26*c* may allow for proper shaving geometry to minimize double engagement of hairs and prevent hair from being cut below the skin surface. In certain embodiments, the bridge member 26*c* may be 3 to 5 times wider than a width of the primary guard 14. The plurality of spaced apart parallel ribs 27*c* may define a rinse opening 29*c* there between to aid in the removal of cut hair and excess shave prep or soap. In certain embodiments, the bridge member 26 may have one or more notches 65*c*, 67*c* and 69*c* to provide clearance for various housing structures. For example, notches 65*c* and 69*c* may allow for clearance of the spring members 62, 64, 66, 68, 70, 72, 74, 76 and 78 (shown in FIG. 4) and notch 67*c* may provide for clearance of a central blade support 75 in the housing 12 (shown in FIG. 4). Although in the view shown, only the notches 65*c*, 67*c* and 69*c* are illustrated, it is understood the other side of the bridge member 26*c* may have similar notches.

Referring to FIG. 4, an assembly view of the shaving razor cartridge 10 is shown. The blades 18 and 20 may each be mounted on a pair of respective spring members 62, 64 and 66, 68 of the housing 12. The bridge member 26 may be mounted on a plurality of spring members 70, 72, 74, 76, 78 and 79. The notches 65*b*, 69*b* 65*c* and 69*c* shown in FIGS. 3B and 3C may allow for clearance of the spring members 70, 72, 74, 76, 78 and 79 so the bridge member 26 can be mounted at the proper height. In addition, the notches 67*b* and 67*c* shown in FIGS. 3B and 3C may provide for clearance of a center blade support 75 of the housing 12. The clips 32*a* and 32*b* may be mounted over the blades 18 and 20 and the bridge member 26 (e.g., top surfaces 54 and 56 of the legs 44 and 46 of the bridge member 26). Although bridge member 26 is shown, it is understood that bridge members 26*b* and 26*c* may alternatively be used. The clips 32*a* and 32*b* may then be secured to the housing 12. The spring members 62, 64 and 66, 68 lift the blades 18 and 20 against the clips 32*a* and 32*b* (e.g., bottom surfaces 34*a* and 34*b* of the clips 32*a* and 32*b*). Similarly, the spring members 70, 72, 74, 76, 78 and 79 may lift the bridge member 26 against the clips 32*a* and 32*b*. In certain embodiments, the bridge member 26 may move independent of the blades 18 and 20, as well as the housing 12, because the bridge member 26 is mounted on its own spring members 70, 72, 74, 76, 78 and 79. The independent movement of the bridge member 26 may provide a more comfortable shave because it allows the bridge member to adjust to forces applied during a shaving stroke. In addition, the pair of legs 44 and 46 may improve stability of the bridge member 26. In certain embodiments, the bridge member 26 may be supported by six spring members 70, 72, 74, 76, 78 and 79 not just two spring members, as in the case of the blades 18 and 20. Accordingly, the bridge member 26 may better distribute shaving loads. As previously explained, the bridge member 26 may be positioned below the top surface of the clips 33*a* and 33*b* and above the top surface 33*a* and 33*b* of the clips 32*a* and 32*b*.

Figure 5:
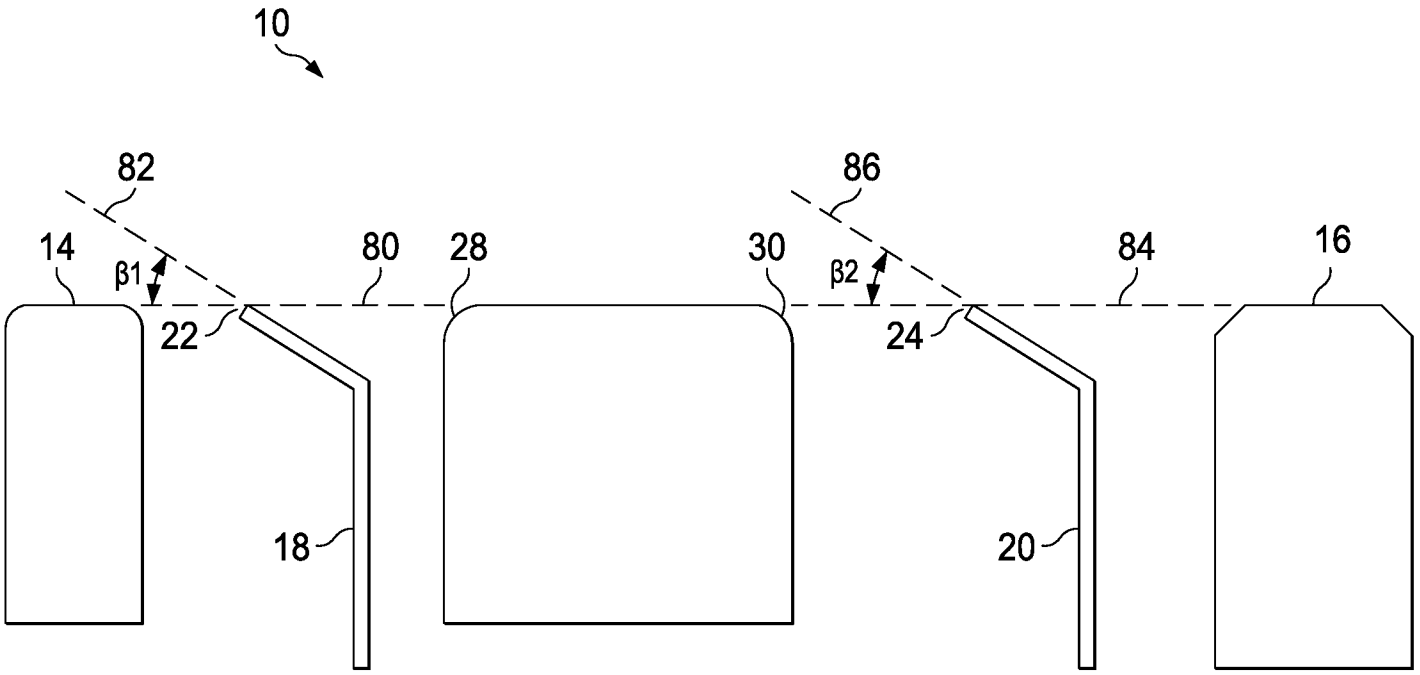
FIG. 5 is a schematic view of the shaving razor cartridge of FIG. 1.

Referring to FIG. 5, a schematic view of the shaving razor cartridge 10 of FIG. 1 is shown. Another factor, which can influence drag forces associated with the blades, is the blade tangent angle or BTA. The shaving razor cartridge 10 may have a first shaving plane 80 tangent to the primary guard 14 and the primary cap surface 28. The first shaving plane 80 may intersect a blade plane 82 of the first blade 18 (i.e., the cutting edge 22) at a first blade tangent angle β1. The shaving razor cartridge 10 may have a second shaving plane 84 tangent to the secondary guard surface 30 and the secondary cap 16. The second shaving plane 84 may intersect a second blade plane 86 of the second blade 20 (i.e., the cutting edge 24) at a second blade tangent angle 132. A lower blade tangent angle may result in a more comfortable shave for the shaving razor cartridge 10. In certain embodiments, the first blade tangent angle β1 may be about 15 degrees, for example 10 degrees to 25 degrees. It is not necessary for both blades 18 and 20 to have the same blade tangent angles. For example, the second blade tangent angle β2 may be less than the blade tangent angle β1 of the first blade 18, for example about 10 degrees.

Combinations:

As example is below:

A. A shaving razor cartridge comprising:

a housing having a primary guard at a front of the housing, a secondary cap at a rear of the housing and at least one spring member positioned between the primary guard and the secondary cap;

a bridge member positioned between the primary guard and the secondary cap, the bridge member having a primary cap surface and a secondary guard surface;

a first blade having a cutting edge, the first blade mounted to at least one of the spring members between the primary guard and the primary cap surface;

a second blade having a cutting edge, the second blade mounted to at least one of the spring members between the secondary guard surface and the secondary cap, wherein the bridge member is mounted on a plurality of the spring members.

B. The shaving razor cartridge of Paragraph A wherein the first blade, the second blade and the bridge member are each independently mounted on separate spring members.

C. The shaving razor cartridge according to any of Paragraphs A or B wherein the bridge member comprises stainless steel, aluminum or copper.

D. The shaving razor cartridge according to any of Paragraphs A-C wherein the shaving razor cartridge comprises only two blades.

E. The shaving razor cartridge according to any one of Paragraphs A-D wherein the bridge member has a width from the primary cap surface to the secondary guard surface of 3 mm to 5 mm.

F. The shaving razor cartridge according to any one of Paragraphs A-E wherein an interblade span from the cutting edge of the first blade to the cutting edge of the second blade is greater than 3.0 mm and the bridge member has a width that is greater than 45% of an interblade span.

G. The shaving razor cartridge according to any one of Paragraphs A-F wherein an interblade span between the cutting edge of the first blade and the cutting edge of the second blade is greater than 2.50 mm.

H. The shaving razor cartridge according to any one of Paragraphs A-G further comprising at least one clip securing the blades and the bridge member to the housing.

I. The shaving razor cartridge of Paragraph H wherein an upper surface of the bridge member is positioned on a plane between a top surface of the at least one clip and a bottom surface and of the at least one clip.

J. The shaving razor cartridge according to any one of Paragraphs A-I wherein the first blade comprises a blade support member and the bridge member is spaced apart from both the first blade and the blade support member to define a rinse gap.

K. The shaving razor cartridge according to any one of Paragraphs A-J wherein the housing defines a plurality of blade slots configured to receive one of the blades or a portion of the bridge member.

L. The shaving razor cartridge of Paragraph K wherein the bridge member overlaps an open blade slot.

M. The shaving razor cartridge according to any one of Paragraphs A-L wherein the bridge member has an upper surface comprising an insignia.

N. The shaving razor cartridge according to any one of Paragraphs A-M wherein the bridge member has a pair of spaced apart legs that are interconnected by a plurality of spaced apart parallel ribs.

O. The shaving razor cartridge according to any one of Paragraphs A-N wherein the bridge member comprises a lubrication member.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor cartridge comprising:

a housing having a primary guard at a front of the housing, a secondary cap at a rear of the housing;

a bridge member positioned between the primary guard and the secondary cap, the bridge member having a primary cap surface and a secondary guard surface;

a first blade having a cutting edge closest to the primary guard, the first blade mounted to the housing between the primary guard and the primary cap surface;

a second blade having a cutting edge closest to the secondary cap, the second blade mounted to the housing between the secondary guard surface and the secondary cap, wherein an interblade span from the cutting edge of the first blade to the cutting edge of the second blade is greater than 3.0 mm and the bridge member has a width from a forward edge to a rear edge of the bridge that is greater than 45% of the interblade span between the cutting edges of the first blade and the second blade and the bridge member has a pair of spaced apart legs positioned within respective blade slots of the housing and the forward edge and the rearward edge overlap the respective legs.

2. The shaving razor cartridge of claim 1 further comprising at least one clip securing the blades and the bridge member to the housing.

3. The shaving razor cartridge of claim 2 wherein an upper surface of the bridge member is positioned on a plane between a top surface of the at least one clip and a bottom surface of the at least one clip, wherein the cutting edges of the first and second blades are preloaded against the bottom surface of the at least one clip.

4. The shaving razor cartridge of claim 1 wherein the bridge member comprises stainless steel, aluminum or copper.

* * * * *